US011708756B2

(12) United States Patent
Al-Salmani et al.

(10) Patent No.: US 11,708,756 B2
(45) Date of Patent: Jul. 25, 2023

(54) SURFACE COMPLETION SYSTEM FOR OPERATIONS AND MONITORING

(71) Applicant: Vault Pressure Control LLC, Houston, TX (US)

(72) Inventors: Zeyad Al-Salmani, Calgary (CA); Jason Williams, Calgary (CA); Saurabh Kajaria, Houston, TX (US)

(73) Assignee: VAULT PRESSURE CONTROL LLC, Houston, TX (US)

( * ) Notice: Subject to any disclaimer, the term of this patent is extended or adjusted under 35 U.S.C. 154(b) by 0 days.

(21) Appl. No.: 17/403,251

(22) Filed: Aug. 16, 2021

(65) Prior Publication Data

US 2021/0372272 A1 Dec. 2, 2021

Related U.S. Application Data

(63) Continuation of application No. 16/681,314, filed on Nov. 12, 2019, now Pat. No. 11,230,917.

(60) Provisional application No. 62/760,719, filed on Nov. 13, 2018.

(51) Int. Cl.

| | |
|---|---|
| ***E21B 34/02*** | (2006.01) |
| ***E21B 47/06*** | (2012.01) |
| ***E21B 47/09*** | (2012.01) |
| ***E21B 41/00*** | (2006.01) |

(52) U.S. Cl.

CPC ..... *E21B 47/09* (2013.01); *E21B 34/02* (2013.01); *E21B 41/00* (2013.01); *E21B 41/0092* (2013.01); *E21B 47/06* (2013.01)

(58) Field of Classification Search

CPC ..... E21B 34/02; E21B 41/0092; E21B 47/06; E21B 47/09; E21B 43/2607

See application file for complete search history.

(56) References Cited

U.S. PATENT DOCUMENTS

| | | | | |
|---|---|---|---|---|
| 3,552,903 | A * | 1/1971 | Townsend, Jr. | E21B 43/017 166/356 |
| 3,643,736 | A * | 2/1972 | Talley, Jr. | E21B 41/08 166/356 |
| 3,777,812 | A * | 12/1973 | Burkhardt | E21B 43/017 166/338 |
| 4,848,474 | A * | 7/1989 | Parizot | E21B 43/017 166/341 |
| 8,220,553 | B2 * | 7/2012 | Crawford | E21B 33/08 166/368 |
| 8,944,159 | B2 * | 2/2015 | Guidry | E21B 33/068 166/177.5 |
| 9,052,061 | B2 * | 6/2015 | He | F16N 1/00 |
| 9,222,555 | B2 * | 12/2015 | Morin | F16H 37/041 |
| 9,315,372 | B2 * | 4/2016 | Doi | F16N 11/10 |

(Continued)

*Primary Examiner* — Daniel P Stephenson

(74) *Attorney, Agent, or Firm* — Morgan, Lewis & Bockius LLP

(57) ABSTRACT

A wellhead monitoring system includes a conversion assembly, the conversion assembly including an actuator element for modifying an operating mode of a valve from manual to remote. The system also includes one or more sensors, associated at least one of a fracturing tree or the conversion assembly, the one or more sensors obtaining wellhead operating conditions. The system further includes a control unit, adapted to receive information from the one or more sensors, the control unit presenting the information, on a display, and transmitting the information to a remote system for analysis.

13 Claims, 10 Drawing Sheets

(56) References Cited

U.S. PATENT DOCUMENTS 9,840,901 B2 * 12/2017 Oehring ..... F04B 15/02
10,260,327 B2 * 4/2019 Kajaria ..... E21B 34/02
10,577,888 B2 * 3/2020 Knott ..... E21B 34/02
10,655,435 B2 * 5/2020 Oehring ..... E21B 41/0092
10,816,137 B2 * 10/2020 Herman ..... E21B 43/26
2006/0124300 A1 * 6/2006 Steiner ..... E21B 21/067 166/372
2009/0050311 A1 * 2/2009 Crawford ..... E21B 19/22 166/90.1
2009/0153354 A1 * 6/2009 Daussin ..... E21B 47/12 340/853.1
2009/0266554 A1 * 10/2009 Wilson ..... E21B 43/122 166/372
2010/0032031 A1 * 2/2010 Neal ..... E21B 21/02 166/381
2010/0051272 A1 * 3/2010 Loree ..... C09K 8/64 166/279
2010/0250139 A1 * 9/2010 Hobbs ..... H04N 7/185 702/6
2011/0030963 A1 * 2/2011 Demong ..... E21B 43/26 166/54.1
2012/0181046 A1 * 7/2012 Kajaria ..... E21B 43/16 166/380
2013/0233560 A1 * 9/2013 Davidson ..... E21B 43/26 166/308.1
2014/0352968 A1 * 12/2014 Pitcher ..... E21B 43/26 166/308.1
2015/0007995 A1 * 1/2015 Livescu ..... C09K 8/64 166/305.1
2015/0114652 A1 * 4/2015 Lestz ..... E21B 43/267 166/308.1
2015/0136409 A1 * 5/2015 Hall ..... E21B 34/04 166/344
2015/0144336 A1 * 5/2015 Hardin ..... E21B 21/106 166/250.01
2015/0345272 A1 * 12/2015 Kajaria ..... E21B 47/00 166/308.1
2016/0061016 A1 * 3/2016 Ciezobka ..... E21B 43/26 166/308.1
2016/0102537 A1 * 4/2016 Lopez ..... E21B 43/26 700/282
2016/0258267 A1 * 9/2016 Payne ..... E21B 44/00
2016/0273346 A1 * 9/2016 Tang ..... E21B 43/04
2016/0298439 A1 * 10/2016 Morrow ..... E21B 43/267
2016/0329697 A1 * 11/2016 Brooks ..... H02H 3/10
2017/0022788 A1 * 1/2017 Oehring ..... F04B 51/00
2017/0146189 A1 * 5/2017 Herman ..... F16N 25/00
2017/0234335 A1 * 8/2017 LeBlanc ..... F15B 13/022 137/315.03
2018/0156004 A1 * 6/2018 Hussain ..... E21B 34/04
2018/0258742 A1 * 9/2018 Sveberg ..... E21B 43/017
2019/0292891 A1 * 9/2019 Kajaria ..... E21B 47/00
2020/0149389 A1 * 5/2020 Al-Salmani ..... E21B 43/2607

* cited by examiner

SURFACE COMPLETION SYSTEM FOR OPERATIONS AND MONITORING

BACKGROUND

1. Field of Invention

This disclosure relates in general to oil and gas tools, and in particular, to systems and methods for monitoring and controlling surface completion operations.

2. Description of the Prior Art

Certain oil and gas operations, such as fracturing operations, may utilize a variety of surface valves and components in order to control various downhole operations. For example, surface valves may be cycled to enable different equipment to pass into wellbores (e.g., frac balls, wireline, etc.). There may be many operations ongoing at one time at the well site, and even a particular pad, and as a result monitoring and recording each operation may be challenging. Moreover, manually operated valves may be positioned within high pressure areas, thereby preventing undesirable working conditions. Because oil and gas operations often utilize rented equipment, it is important that operations are conducted efficiently and that wells are not subject to large amounts of "nonproductive time" (NPT) where the well sits idle. The undesirable conditions, as well as multiple operations continuing at the same time, may increase NPT at well sites, thereby reducing profitability.

SUMMARY

Applicant recognized the problems noted above herein and conceived and developed embodiments of systems and methods, according to the present disclosure, for operating electric powered fracturing pumps.

In an embodiment, a wellhead monitoring system includes a conversion assembly, the conversion assembly including an actuator element for modifying an operating mode of a valve from manual to remote. The system also includes one or more sensors, associated at least one of a fracturing tree or the conversion assembly, the one or more sensors obtaining wellhead operating conditions. The system further includes a control unit, adapted to receive information from the one or more sensors, the control unit presenting the information, on a display, and transmitting the information to a remote system for analysis.

In an embodiment, a wellhead monitoring system includes a pressure sensor arranged at a fracturing tree, the pressure sensor being communicatively coupled to a control unit. The system also includes a valve position sensor arranged at a valve of the fracturing tree, the valve position sensor being communicatively coupled to the control unit. The system also includes an actuator unit, coupled to the valve, the actuator unit controlling operation of the valve to transition the valve between an open position and a closed position. The control unit is arranged at a location remote from the fracturing tree and outside of a pressure zone, the control unit collecting information from the pressure sensor and the valve sensor, the control unit further operable to drive movement of the valve via the actuator unit.

In an embodiment, a method for monitoring operations at a well sit includes receiving, from a pressure sensor, pressure information for a fracturing tree, the pressure information indicative of an operational stage. The method also includes receiving, from a valve position sensor, valve position information for a valve of a fracturing tree, the valve being moveable between an open position and a closed position, the valve information being indicative of the operational stage. The method further includes determining, based at least in part on the pressure information and the valve position information, a current status of a wellhead. The method also includes determining, based at least in part on the current status of the wellhead, time information of the wellhead, the time information identifying different operational stages of the wellhead over a period of time.

In embodiments, a wellhead monitoring system includes at least one of a pressure sensor or a valve position sensor, communicatively coupled to a control system, the at least one of the pressure sensor or the valve position sensor transmitting information indicative of a wellbore operation to the control unit. Additionally, the system includes the control system, executing, via a processor, an algorithm stored on non-transitory memory. The control system includes receiving, from the at least one of the pressure sensor or the valve position sensor, first information indicative of the wellbore operation. Additionally, the control system includes determining, based at least in part on the first information, a first status of the wellhead. The control system also includes determining, based at least in part on the first information, a first time of the first status. The control system further includes receiving, from the at least one of the pressure sensor or the valve position sensor, second information indicative of the wellbore operation. The control system also includes determining, based at least in part on the second information, a second time of the second status. The control system includes determining, based at least in part on a difference between the first status and the second status, a working time for the wellbore operation.

BRIEF DESCRIPTION OF THE DRAWINGS

The present technology will be better understood on reading the following detailed description of non-limiting embodiments thereof, and on examining the accompanying drawings, in which.

DETAILED DESCRIPTION OF THE INVENTION

Figure 1:
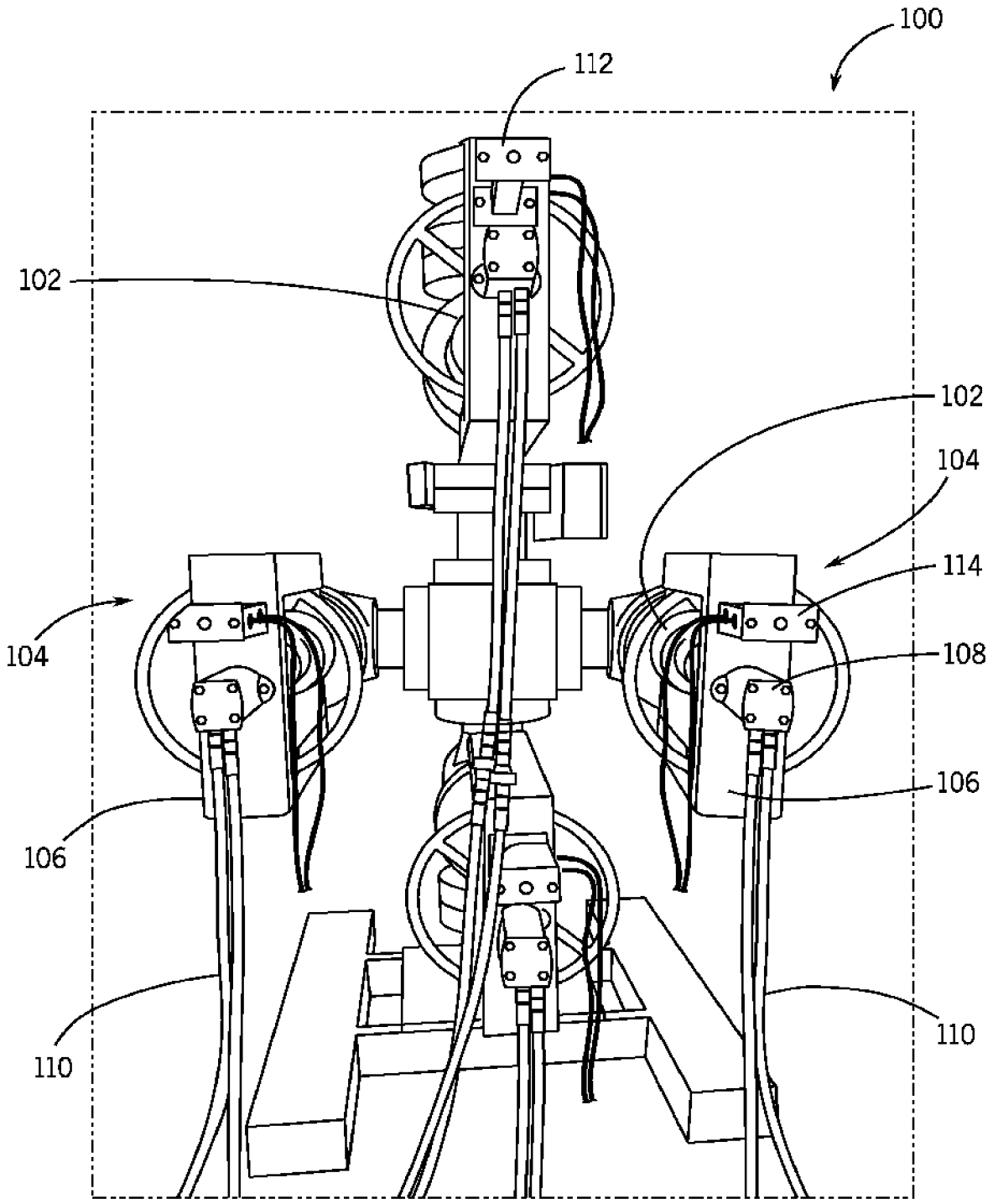
FIG. 1 is a perspective view of an embodiment of a frac tree with a conversion assembly, in accordance with embodiments of the present disclosure.

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present invention are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations.

Embodiments of the present disclosure are directed toward, among other things, improving efficiency of fracturing operations. For example, fracturing operations may be approximately 60 percent efficient, thereby costing operators significant amounts of money in order to complete operations. One problem stems from having multiple vendors on site performing a variety of different tasks, and as a result, non-productive time (NPT) may be difficult to track for all of the vendors. This is a significant problem, as an hour of NPT may cost operators approximately $10,000. Accordingly, it is important for operators to be able to identify and track NPT to develop solutions. Furthermore, safety is important at the well site. Fracturing operations may be conducted in harsh environments under high pressures, and as a result, continuous monitoring of valve positions and wellbore pressure may enable safer operations. Often, pressure is not monitored at a frac tree, as customers may be resistant to having their pressure readings located there, since visual verification would lead to an employee getting close to the frac tree, which may be under pressure. Systems and methods of the present disclosure address these problems by tracking NPT, along with providing continuous monitoring of pressure and valve positions. The pressure and valve position monitoring may be conducted at a remote location, thereby improving safety at the well site. In certain embodiments, the information collected may be provided on a visual interface to the operators.

Embodiments of the present disclosure include conversion assemblies that may convert a manually operated valve into a remotely operated valve. In embodiments, remote operation is enabled by providing an actuator that couples to a manually operated valve without taking the valve out of service. For example, the conversion assembly may include a frame for securing the actuator to the valve body and an interface for engaging one or more components of the valve, such as a gate or valve stem. In various embodiments, the actuator may be driven by a pneumatic source, an electrical source, a hydraulic source, or any other reasonable source. Often, these sources are already present at the well site, and as a result, integration of the conversion assembly into the well site may be simple, thereby lowering a barrier of entry to use. In various embodiments, the conversion assembly includes a position sensor, which may be indicative of a position of the valve. For example, the position assembly may determine whether the valve is in a closed position, an open position, or an intermediate position. The conversion assemblies may be remotely operated, for example from a remotely positioned control panel, such that operators will not be arranged within a pressure zone of the frac tree (e.g., an area surrounding the frac tree that may be susceptible to damage or health hazards). As a result, operators may continue to remotely operate the valves while keeping personnel away from the frac tree.

In various embodiments of the present disclosure, one or more pressure sensors may be incorporated into the frac tree in order to facilitate remote monitoring and control of the fracturing site. By way of example, the pressure sensors may be communicatively coupled to the control panel, which may include a display to relay information from the pressure sensors to the operator. As a result, the operator may be able to evaluate a particular mode or stage within the fracturing operation, which may drive additional operations. For example, an indication of low pressure or no pressure within a portion of the well may illustrate a well that is blocked in.

Embodiments of the present disclosure may further provide systems and methods for monitoring and tracking operations at the well site in order to improve efficiencies by determining operational stages at the well site. For example, systems and methods may track non-productive time (NPT) at the well site to determine when operators are at the site, but not performing certain duties due to one or more other situations at the well site. As an example, if a first operator is a pressure pumper, that operator may not be able to perform pumping operations until a second operation, which may be a sand supplier, provides sand to form the slurry that is injected during a fracturing operation. As a result, it may not be economical for the well site operator to have the first operator at the site until the sand has been delivered. Additionally, certain operators may not be able to perform their duties during pumping operations, and as a result, having them on site during pumping may cost the well site operator unnecessary money. Accordingly, embodiments of the present disclosure may track operations at the site in order to identify various stages, which may be useful in recognizing efficiencies at the well site and/or for deploying different crews to the well site. For example, if the well site operator can determine that the well site will be ready for pressure pumping in 2 days, the well site operator may plan for the pressure pumper to arrive at that time, rather than having the pressure pumper arrive earlier and/or later.

Various embodiments describe a user interface and display module for presenting information, for example at the control panel, for operators to track and monitor well site operations. In various embodiments, systems and methods may include a software application, which may be locally hosted or part of a distributing computing offered (e.g., Software as a Service) to monitor and optimize operations by minimizing operational uncertainty, capturing NPT, reducing unplanned outages, and improving safety. The system may include real time monitoring and recording of events, secure and efficient management of operations data, and a visualization interface to stream live operations data. As a result, owner and operators can determine leaks and pressures spikes to improve operational efficiency, ensure reliable and optimized operation through real time operational data analytics, including information on NPT, enhance operational safety and minimize operational uncertainty by adjacent well monitoring and erosion monitoring, and prepare detailed pad report summaries. In various embodiments, machine learning systems may also be incorporated in order to provide predictive analytics. By way of example only, machine learning systems may identify certain characteristics of a fracturing operation, such as formation properties, and correlate those to pumping information in order to predict potential breakthroughs and the like. The system may utilize this information to provide notifications of upcoming events, thereby enabling operators to plan ahead in a proactive, rather than reactive, manner.

FIGS. 1-10 describe various embodiments of systems and methods for controlling and monitoring well operations, for example during completion operations at a fracturing site. In various embodiments, systems may include one or more assemblies to convert manually actuated valves into remotely controllable valves, for example, via hydraulic, pneumatic, electric, or other actuation devices. The assemblies may include a valve frame (e.g., actuation frame, actuator frame) that couples to a stem of an existing valve, for example as part of a frac stack or frac tree (e.g., a collection of valves and piping at a surface location of a fracturing operation). The frame may be mounted to the exiting valve, for example in the field, and may also be field removable. The actuator on the frame may be remotely controllable, for example via a control system or control panel, and therefore operators may not enter the pressure zone around the fracturing operation. In various embodiments, the valve frame may also couple to actuated valves.

Various embodiments of the present disclosure include one or more sensors associated with the assembly and/or the valve frames. For example, the sensor may be a position indicator that determines whether the valve is in an open position or a closed position. In various embodiments, the sensor may evaluate a position of the valve stem to determine whether the valve is in an open position or a closed position. Additionally, in other embodiments, the sensor may evaluate a pressure (e.g., a hydraulic pressure, a pneumatic pressure) within a chamber of the actuator to determine whether the valve is in the closed position or the open position. It should be appreciated that various sensor arrangements may be incorporated into the assembly and/or valve frame in order to monitor a position of the valve.

In various embodiments, additional sensors may further be incorporated into the assembly to evaluate one or more properties of the frac tree and/or ongoing wellbore operations. For example, the additional sensors may be pressure transducers that determine a wellbore pressure at various times. The wellbore pressure may be indicative of an ongoing operation within the wellbore. For example, a pressure pumping operation would result in high pressure, due to the pressure of the fluid injected into the well to enable hydraulic fracturing. However, a low pressure may be indicative of a shut in well or other wellbore operation.

Embodiments of the pressure disclosure may also include a software system to monitor information from the wellbore, the assembly, user input information, or the like to determine or more properties associated with the wellbore. For example, the output from the position sensor may be indicative of what stage of operation the wellbore is in because multiple cycles of the valve may be indicative of certain operations. Additionally, in embodiments, the pressure may also be indicative of the operation. Furthermore, the software system may enable user inputs to provide information, such as the vendor currently in operation, start times, and the like. Accordingly, the system may identify certain event types and also maintain a count of the events. Combination of information may be utilized to compute non-productive time (NPT). NPT may refer to a state where no operations are being conductive. As described above, NPT may be undesirable at least because operators continue to pay for equipment that sits idle at the well site. In various embodiments, an identification of down time may enable the system to transmit a notification, for example to one or more shareholders, to alert them of down time at the well. In certain embodiments, information may be collected and aggregated from multiple pads of well sites, to bench mark and compare operation performance. In various embodiments, the software system is operational through a distributed computing environment (e.g., cloud computing environment) to enable remote access from a variety of different locations.

Figure 2:
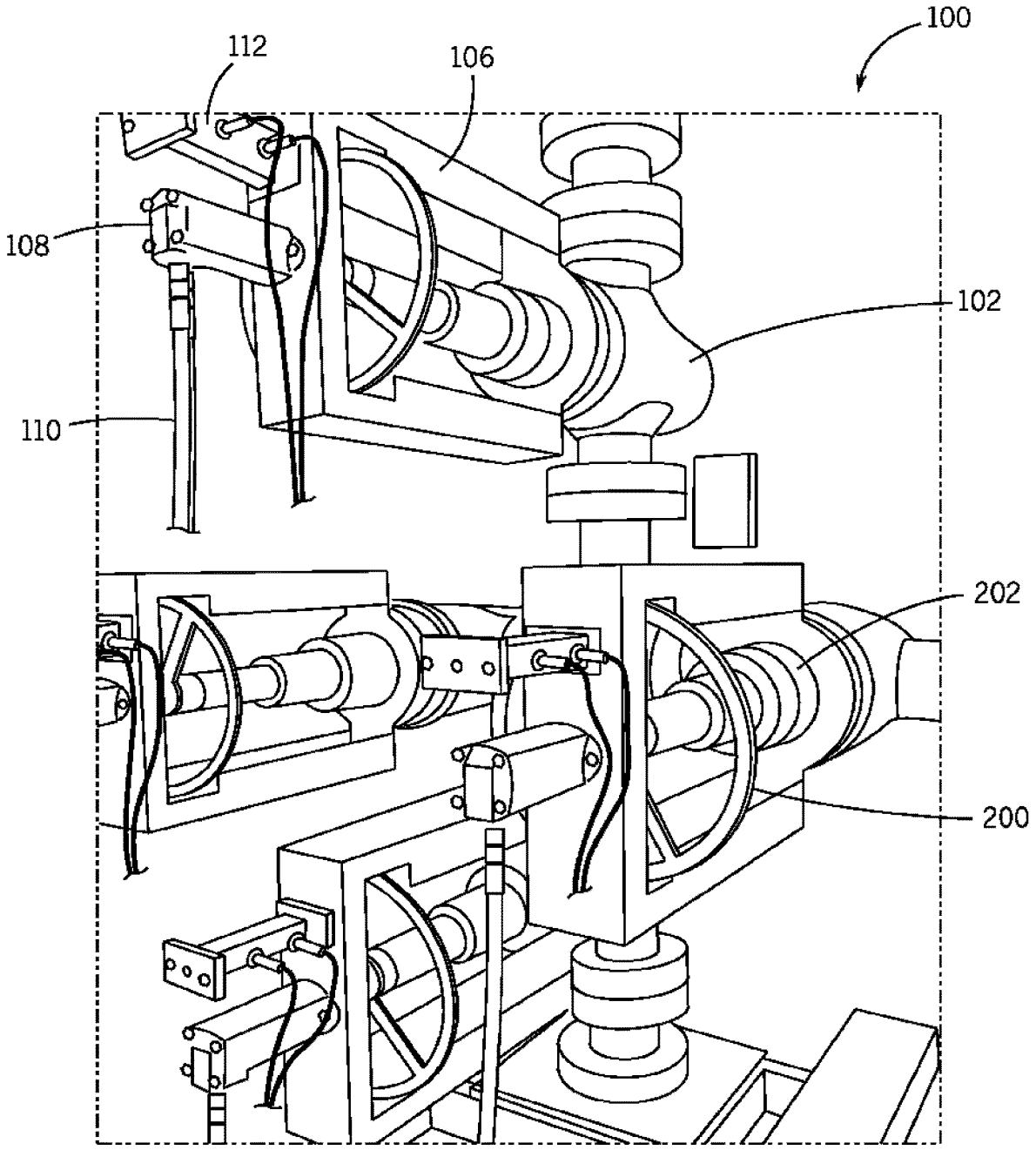
FIG. 2 is a perspective view of an embodiment of a frac tree with a conversion assembly, in accordance with embodiments of the present disclosure.
Figure 3:
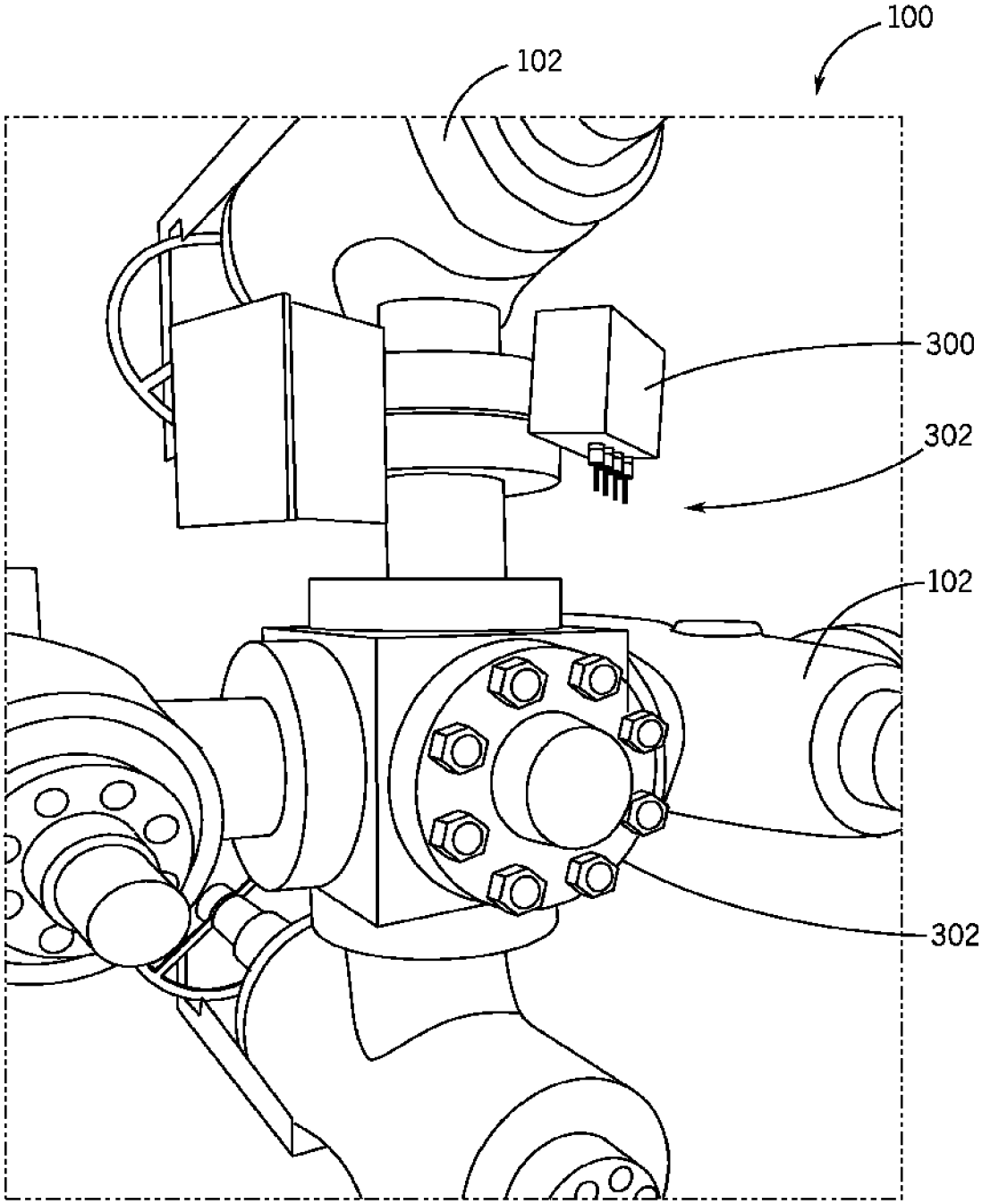
FIG. 3 is a perspective view of an embodiment of a frac tree with a conversion assembly, in accordance with embodiments of the present disclosure.

FIGS. 1-3 illustrate embodiments of a fracturing tree (e.g., frac tree) including a conversion assembly that convert manually operated valves into remotely controllable actuated valves. The illustrated frac tree includes valves and piping components, as described above. It should be appreciated that the frac tree may include more components than those illustrated herein, and that the illustration frac tree is for example purposes only and is not intended to be limiting as to the only components that may be utilized with the frac tree.

As illustrated, the conversion assembly includes valve frames that couple directly to the valves of the frac tree. The valve frames in the illustrated embodiment are coupled to the fasteners of the valve bonnet, however it should be appreciated that the valve frames may be otherwise coupled to the valves. The valve frames include an actuation element that couples to the stem for driving movement of the valves between an open position and a closed position. In the embodiment illustrated in FIG. 2, the valve frame engages hand wheels of the valves. The actuation element may be hydraulically driven, for example via hydraulic fluid pumped via hoses, as illustrated. Additionally, in various embodiments, the actuation element may be pneumatic, electric, or the like.

The valve frame further includes a sensor to evaluate a position of the valve. The position may be related to whether the valve is open, whether the valve is closed, or some condition in between (e.g., how much flow is enabled through the valve). The valve frame further includes a pressure transducer, which may determine a pressure within the wellbore or some other location of the well and/or frac tree. As noted above, the pressure may be indicative of an operation conducted via the frac tree.

FIG. 1 is an isometric view of an embodiment of a fracturing tree 100, which may be arranged at a well site during a fracturing operation. While not illustrated in FIG. 1 for simplicity, the fracturing tree 100 may be coupled to a wellbore formed in an underground formation. Furthermore, the well site may include additional equipment, which is not pictured, such as various piping arrangement, fracturing pumps, sand loaders, and the like. During hydraulic fracturing operations, high pressure fluids, which may be slurry mixtures of components such as liquids and abrasives, may be injected into the wellbore, through the fracturing tree 100, at high pressures. The high pressures crack the formation, thereby forming fissures extending into potentially hydrocarbon producing zones. The abrasives may remain in the fissures after the fluid is removed from the wellbore, thereby propping open the fissures to facilitate hydrocarbon flow.

In various embodiments, the fracturing tree 100 may include valves 102, among other components, that regulate flow of fluid into and out of the wellbore. For example, certain valves may be moved between closed positions and open positions in order to direct fluids through the wellbore. In various embodiments, the valves may be operational via manual controls, such as hand wheels. These control systems, however, may be undesirable when the fracturing tree 100 is exposed to high pressures because of potential safety concerns with having operators within a zone of pressure formed around the fracturing tree 100. Additionally, including various meters and sensors at the fracturing tree 100 faces similar problems because operators may have difficulty reading the sensors without getting close, which as noted above, is undesirable in high pressure applications.

Embodiments of the present disclosure included conversion assemblies 104 that may be utilized to convert manually operated valves 102 into remotely operated valves. Additionally, in various embodiments, the conversion assemblies 104 may further be utilized to convert actuated valves into valves actuated by a different mechanism (e.g., convert a pneumatic actuator into a hydraulic actuator). In certain embodiments, the conversion assemblies 104 include a valve frame 106 for coupling to the valves 102. For example, the valve frame 106 may be coupled to a body of the valve 102, thereby securing the conversion assembly 104 to the valve 102. The illustrated conversion assemblies 104 further include an actuator element 108, which may be a remotely-actuatable element, such as a hydraulic actuator, a pneumatic actuator, an electrical actuator, or the like. The actuator element 108 may couple to a valve stem or a manual operator, which may then drive movement of the valve stem between an open position and a closed position. In this manner, the conversion assembly may be used in order to adjust operation of the valves 102.

In various embodiments, one or more flow lines 110 are utilized to provide motive power to the illustrated actuator elements 108. For example, the flow line 110 may enable hydraulic fluid to enter and exit a chamber of the actuator element 108, thereby driving movement of the valve stem to adjust a position of the valve. It should be appreciated that the flow line 110 are for illustrative purposes only and that other systems and methods may be incorporated to provide motive power to the actuator elements 108. Furthermore, the relative location of the flow line 110 is also for illustrative purposes.

One or more sensors may be incorporated into the conversion assembly 104 in order to facilitate operation of the monitoring system, as described above and later herein. The sensors may obtain the same or different information for each valve 102 and/or for the frac tree 100. For example, a first sensor 112 may correspond to a pressure sensor that receives a signal indicative of a pressure within the wellbore, within the frac tree 100, within a leg of the frac tree 100, or a combination thereof. For example, the pressure sensor may be a pressure transducer that is exposed to a pressure within the frac tree 100 and/or the wellbore. In various embodiments, the pressure sensor 112 may enable monitoring of stages of the fracturing operation, as described below, as different stages may be indicative of different operating pressures.

Further illustrated in FIG. 1 is a second sensor 114, which may correspond to a position sensor for the conversion assembly 104, and therefore for the valve 102. For example, the second sensor 114 may monitor a position of the valve stem, which may be correlated to a closed position for the valve, an open position for the valve, or any number of intermediate positions for the valve. As a result, flow into and out of the wellbore may be monitored, which as noted above, may be correlated to different stages of the fracturing operation.

It should be appreciated that various other sensors and monitors may also be included within the frac tree 100, and that the illustrated pressure and position sensors are for illustrative purposes only. In embodiments, flow sensors may also be incorporated into the system, thereby enabling monitoring of fracturing fluid flow into and/or out of the wellbore. Additionally, pressure sensors may be associated with the motive power source for the actuator elements 108, which may also be correlated to a valve position. As will be described below, one or more of the sensors may receive and transmit information to a control system, which may utilize analytics to categorize different operations of the well site, determine a phase of the operation, and/or monitor ongoing activities, which may improve well site operations.

FIG. 2 is a perspective view of the frac tree 100 illustrating an alternative angle as compared to FIG. 1. In the illustrated embodiment, the valves 102 are manually controlled valves that include hand wheels 200 for driving movement of the valve stem. In the illustrated embodiment, the valve frames 106 couple to the valve via a bonnet 202 such that the actuator element 108 engages the valve stem and/or the hand wheel 200. In various embodiments, at least a portion of the stem may extend through the hand wheel 200, enabling direct engagement to the stem. However, in other embodiments, direct engagement with the hand wheel 200 may be preferred.

FIG. 3 is a perspective view of the frac tree 100 illustrating junction boxes 300. The junction boxes 300 may receive one or more connectors 302 coupled to the various sensors integrated into the frac tree 100. In various embodiments, the junction boxes 300 may also couple to a control system, as described below. The junction boxes 300 may also include wireless communication systems, although the illustrated embodiment features the connectors 302.

Figure 4:
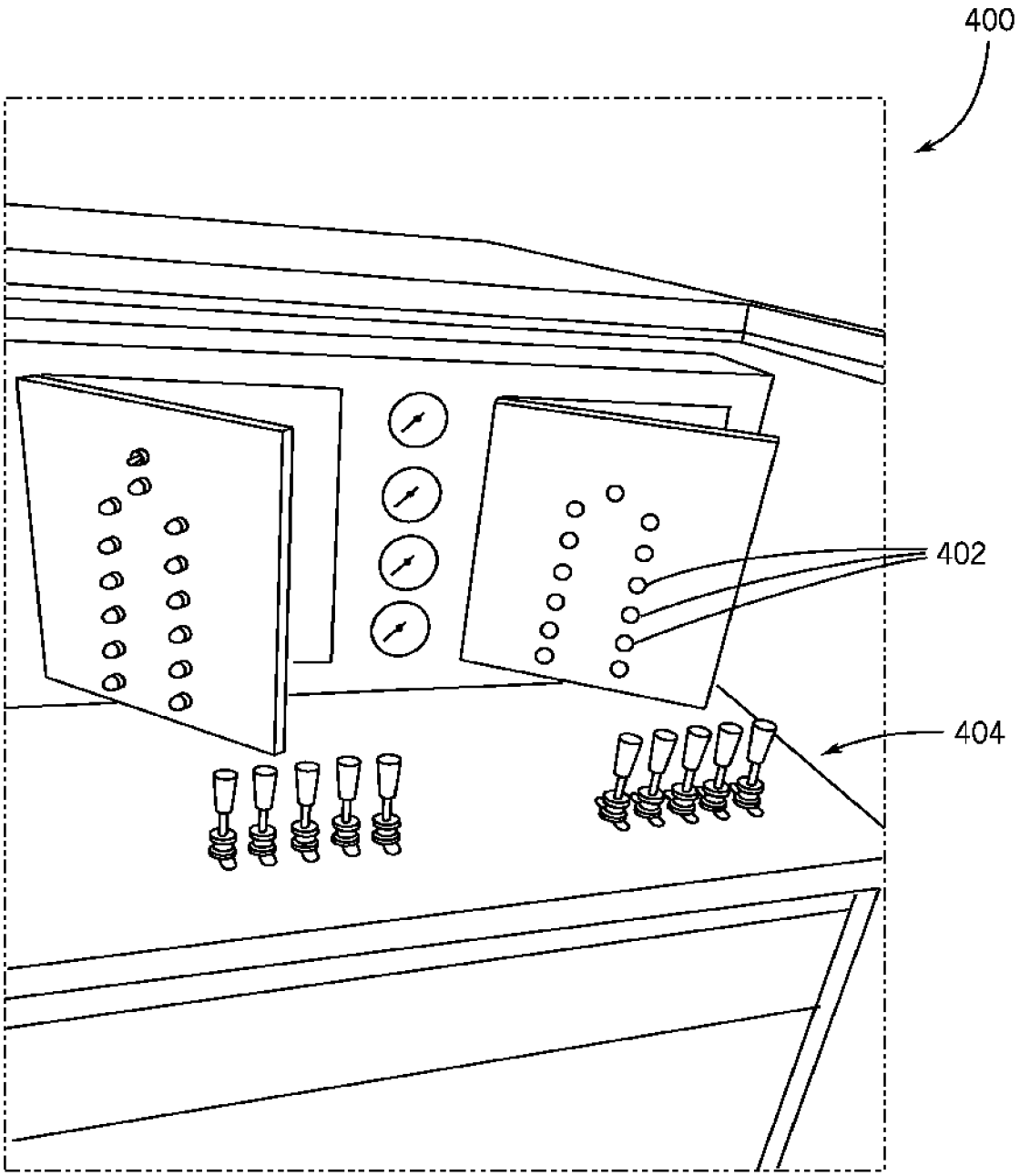
FIG. 4 is a perspective view of an embodiment of a control panel, in accordance with embodiments of the present disclosure.

FIG. 4 is a perspective view of a control panel 400, which may be arranged proximate the frac tree 100 or at a remote location. The control panel includes indicators 402, which may illuminate to provide an indication of various components, such as valve position, pressures, and the like. Moreover, controls 404 may be integrated into the control panel 400 to direct operation of one or more components. For example, the controls 404 may send a signal to transmit fluid into the actuator elements 108, thereby driving movement of the valves 102.

It should be appreciated that the control panel 400 is provided for illustrative purposes only. In various embodiments, operation of the one or more components may be executed via digitally executing software systems, such as those executing on a personal client device. As a result, a user may interact with a display executing the software in order to drive adjustments at the wellsite, such as moving a valve between an open position and a closed position. As noted herein, the operations may be executed remotely from the wellsite, by way of example, at a location outside of a pressure zone of a wellhead.

Figure 5:
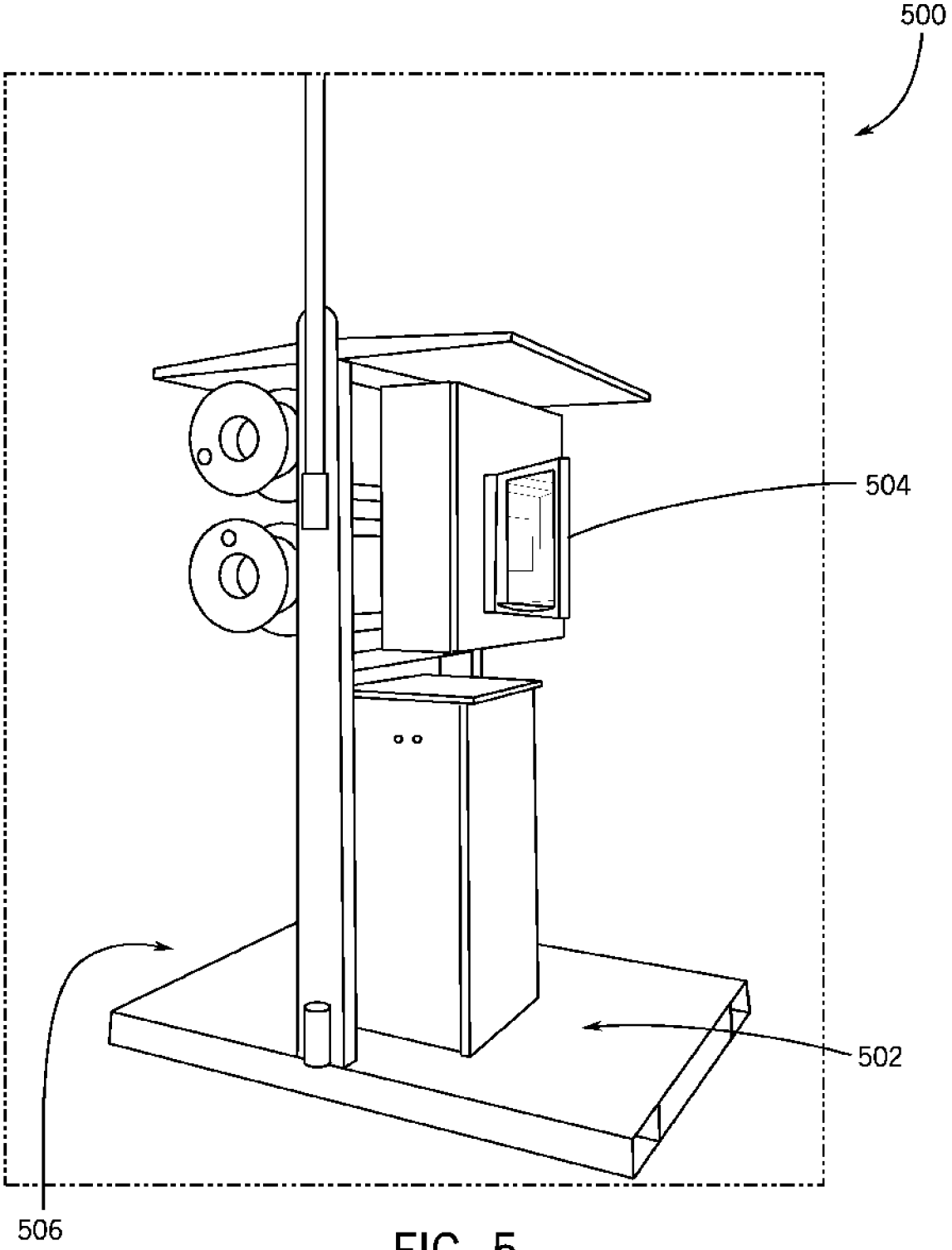
FIG. 5 is a perspective view of an embodiment of a control unit, in accordance with embodiments of the present disclosure.
Figure 6:
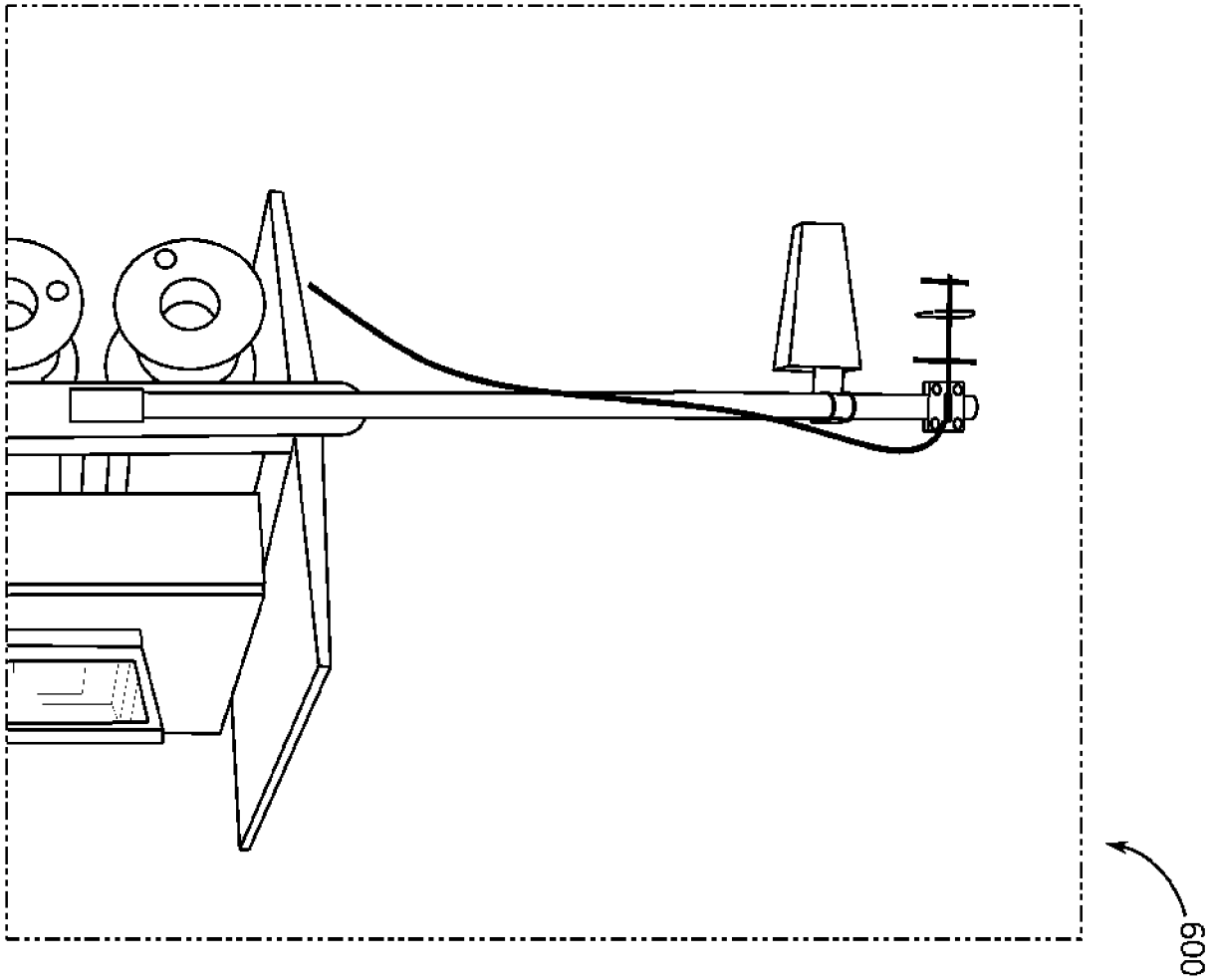
FIG. 6 is a perspective view of an embodiment of a control unit, in accordance with embodiments of the present disclosure.
Figure 7:
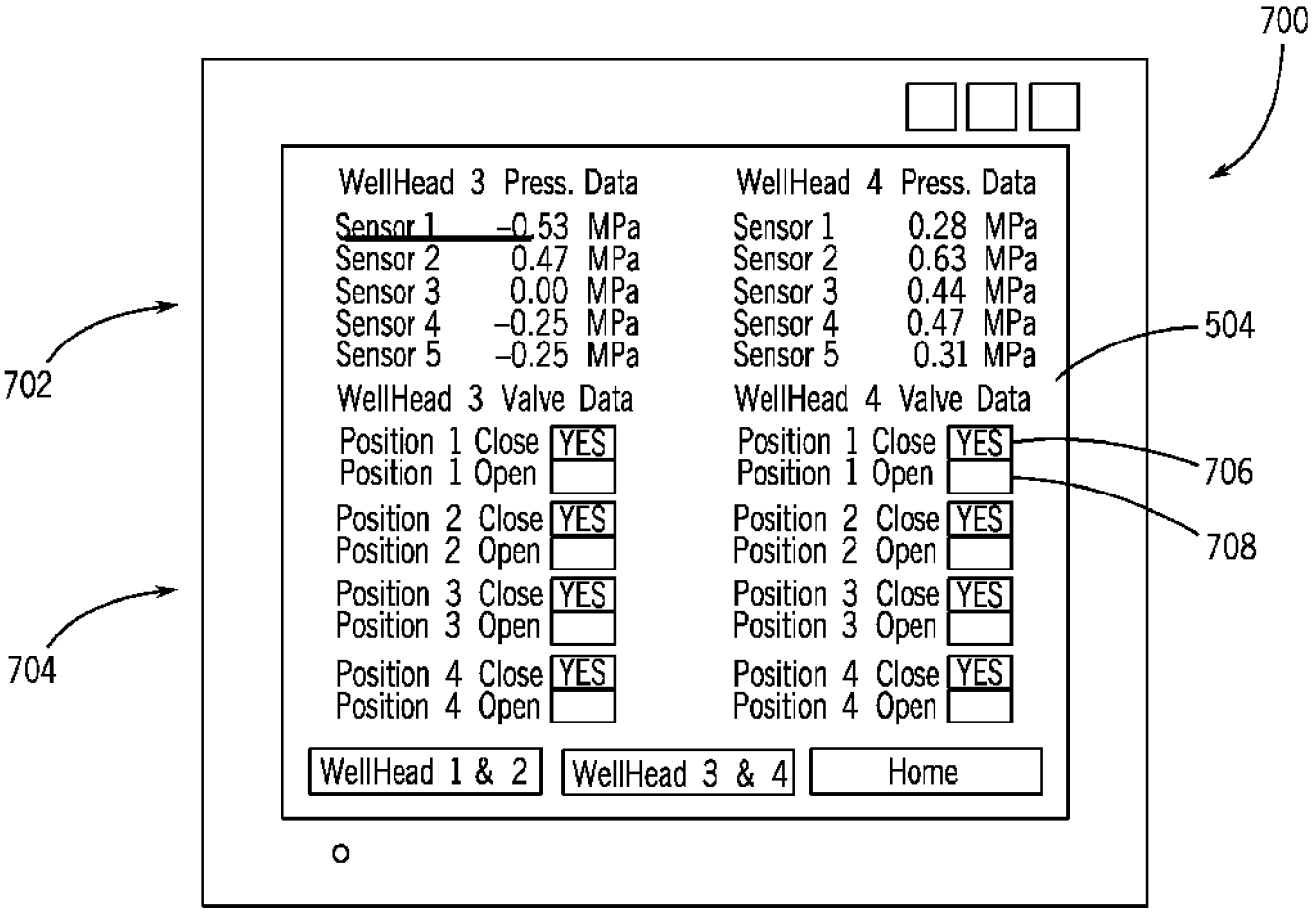
FIG. 7 is a perspective view of an embodiment of an interface, in accordance with embodiments of the present disclosure.

FIGS. 5-7 illustrate a remote control unit including a panel for controlling operation of the valves of the frac tree. The remote control unit may include a memory and a processor, for example as part of a computer system. The processor may execute instructions stored on the memory to conduct one or more operations. Moreover, the memory and processor may be utilized to collect and analyze information received from the one or more sensors associated with the system. As described above, in various embodiments the remote control unit may be utilized to control operation of the valves from a distance away from the frac tree, for example, outside of a pressure barrier associated with the well and/or pad. In various embodiments, the remote control unit includes a communication unit, such as a wireless transceiver, to send and receive instructions. For example, the wireless transceiver may transmit instructions to the valve actuators. However, it should be appreciated that, in other embodiments, data transmission may be conducted over wired communications. The wireless transceiver may also be used to send and receive remote messages, for example, to transmit data away from the well site for further processing.

The illustrated embodiment further includes a display, which may relay information to the user regarding pressures, valve state, and the like. The user may interact with the display to view a variety of different information, as well as to transmit instructions to the actuators at the well site. As will be described below, the display may provide real or near-real time (e.g., without significant delay) information regarding operations at the fracturing site. For example, current well configurations may be shown on the display, such as illustrating which wells are live with pressure, which valves are in open/closed/intermediate positions, and the like.

FIG. 5 is a perspective view of an embodiment of a control unit 500, which may incorporate one or more features of the control panel 400 described above. In various embodiments, the control unit 500 is configured to be moveable about the well site and between different sites, thereby increasing flexibility for its use. The illustrated control unit 500 includes a control system 502 and a display 504. The control system 502 may include a computer system including at least one processor and at least one memory unit. The processor may execute instruction stored on the memory unit and/or instructions received, for example via a communications unit 506. The communications unit may include wired or wireless communication capabilities to facilitate receipt and transmission of instructions and/or data at the well site. For example, in the illustrated embodiment various connectors 302 are coupled to the control system 502, illustrating how wired communication systems may be utilized. Moreover, a wireless communication system, which may be part of the communication unit 506, is illustrated, which may be utilized for wireless communication. Advantageously, the control unit 500 may be arranged at a location remote from (e.g., at least a specified distance away from) the frac tree 100. For example, the control unit 500 may be positioned outside of a pressure zone.

FIG. 6 is a perspective view of an embodiment of a wireless communication system 600, which may be used to send and/or receive signals at the well site. In various embodiments, software executing on the control system 502 may be hosted software, and as a result, the wireless communication system 600 may be used in order to connect to a remote server to receive the software for execution at the site. Moreover, in embodiments, the wireless communication system 508 may be used to transmit data for further processing, among other features. It should be appreciated that a variety of different wireless communication systems may be included, such as cellular communication protocols, near field communication protocols, wireless internet protocols, and the like.

FIG. 7 is a schematic view of an embodiment of the display 504 illustrating a user interface 700, which the operators may utilize to receive information and/or send instructions. In the illustrated embodiment, the user interface 700 provides information indicative of well operations. For example, a first region 702 includes pressure information. The first region 702 is divided into two areas, each providing pressure information to for different wellheads associated with the well site (e.g., Wellhead 3 and Wellhead 4). A second region 704 provides information regarding valve data for the wellheads. In embodiments, color-coding may be utilized to provide the valve information, such as a green icon 706 for an open valve and a red icon 706 for a closed valve. Alternatively, or in addition, different icons 708 may be selected for the valve position, for example, the icon 706 may correspond to an open valve and the icon 708 may correspond to a closed valve. Furthermore, in embodiments, multiple systems may be utilized to communicate information to the operator. For example, visual indicators may include sounds, illumination of particular icons, textual displays, or a combination thereof. Furthermore, auditory or tactile notifications may also be included within the system. In this manner, operators may quickly view the display 504 to obtain operating information. As noted above, this information may be recorded, for example with a time stamp, and processed to achieve additional information regarding operating conditions at the well site.

Figure 8:
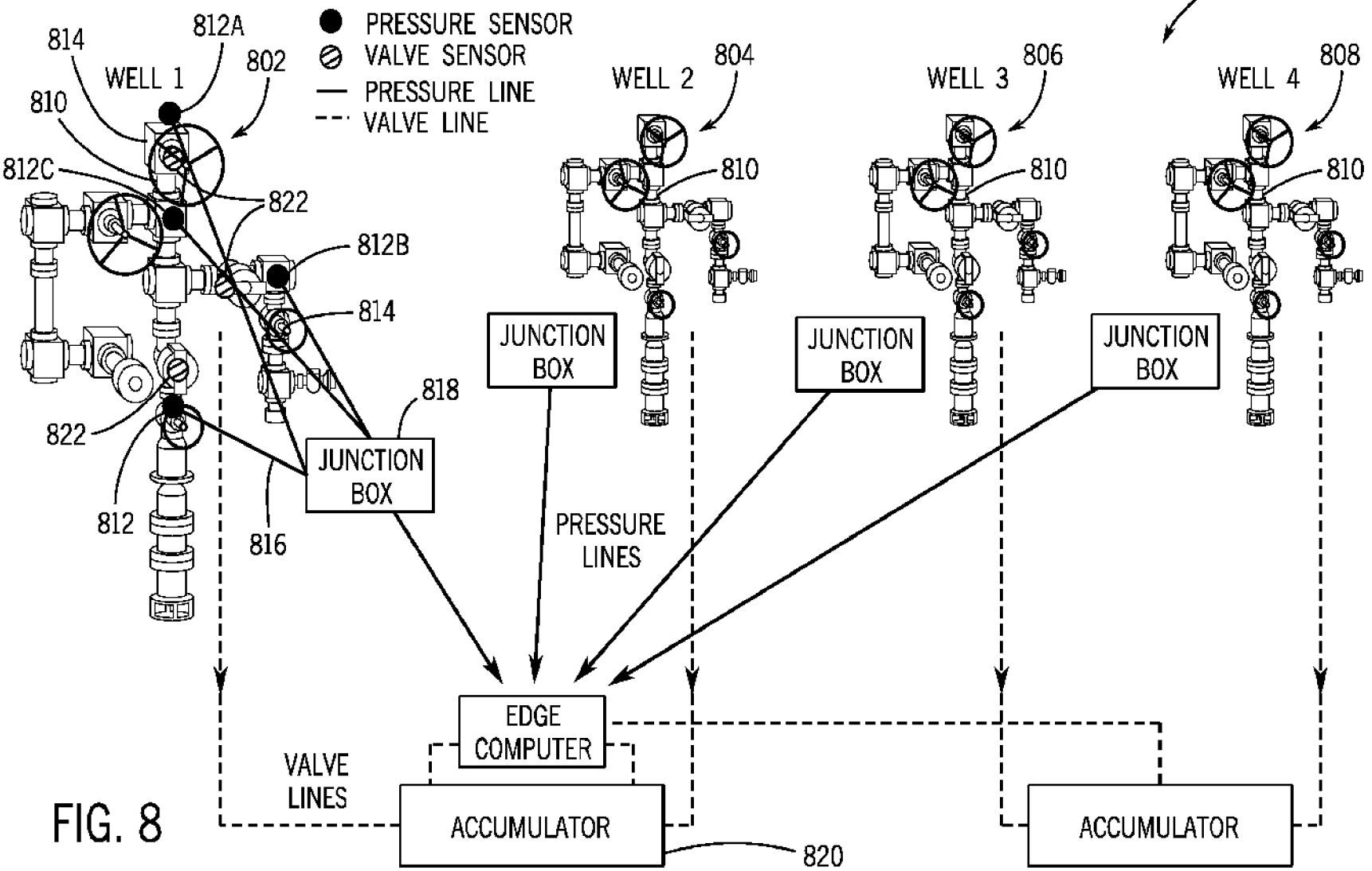
FIG. 8 is a schematic view of an embodiment of a well system, in accordance with embodiments of the present disclosure.

FIG. 8 is a schematic diagram of an embodiment of a wellbore system 800 that may be utilized with embodiments of the present disclosure. The illustrated system 800 includes four wellheads, which may be described as a first wellhead 802, second wellhead 804, third wellhead 806, and fourth wellhead 808. Each wellhead includes a fracturing tree 810, such as the fracturing tree 100 described above, which may include one or more components described herein, such as the various sensors and/or conversion assembly. The wellheads 802, 804, 806, 808 may be in relatively close proximity to one another, such as within 10 to 20 feet. However, it should be appreciated that the wellheads 802, 804, 806, 808 may be closer or farther away from one another.

By way of example with a focus on the first wellhead 802, pressure sensors 812 are arranged at various locations on the fracturing tree 810. A first pressure sensor 812A is proximate a top of the first wellhead 802, a second pressure sensor 812B is along a leg of the first wellhead 802, and a third pressure sensor 812C is at a second leg of the first wellhead 802. Each of these pressure sensors 812 may provide different information, such as being indicative of one or more closed valves 814. The pressure sensors 812 may include one or more connectors 816 to transmit information to a junction box 818, as described above. The junction box 818 may be communicatively coupled to the control unit 500, which may also be referred to as an edge computer, to receive and process pressure information for the respective wellheads.

In the illustrated embodiment, accumulators 820 may be utilized to drive movement of the actuator elements 108 associated with the valves 814, which may be part of the conversion assemblies described above. The illustrated valves 814 include valve sensors 822 arranged at various valves that may provide information regarding a valve position, such as being in an open position, a closed position, or an intermediate position. Information from the valve sensors 822 may also be relayed to the control unit 500, thereby providing additional operating information that may be monitored and evaluated, as described herein.

It should be appreciated that pressure sensors and valve position sensors are provided for illustrative purposes only and their disclosure is not intended to be limiting. For example, other potential sensors include, among others, erosion sensors that may be placed with components of the wellhead or associated equipment in order to monitor erosion at the wellsite. Furthermore, one or more sensors may be arranged on associated equipment, such as pumps at the site, or at nearby wellsites, which may provide information indicative of operations at the wellsite.

Figure 9:
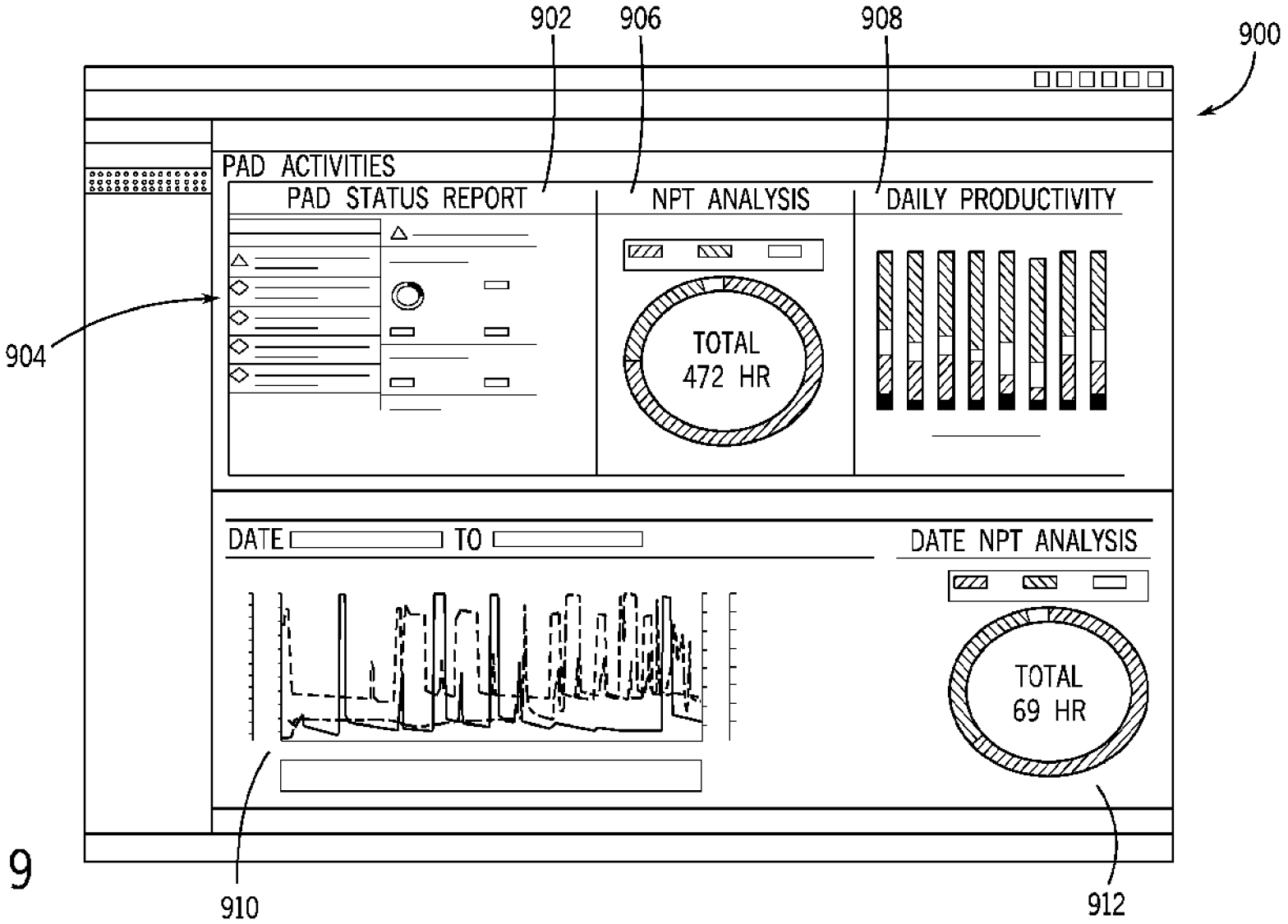
FIG. 9 is a schematic view of an embodiment of an interface, in accordance with embodiments of the present disclosure.
Figure 10:
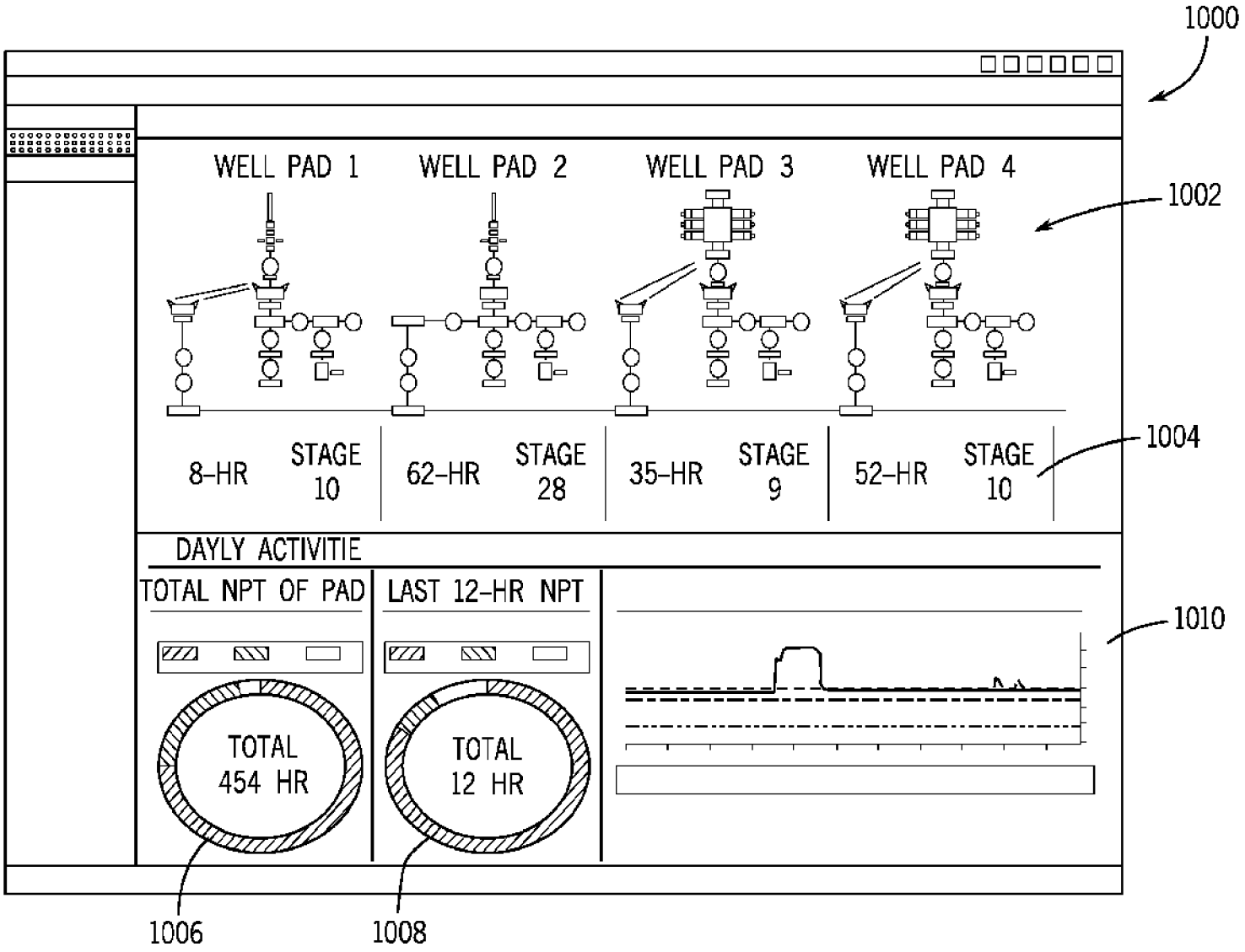
FIG. 10 is a schematic view of an embodiment of an interface, in accordance with embodiments of the present disclosure.

FIGS. 9 and 10 are schematic representations of sample user interfaces that may be utilized with a software system that may receive information from the wellbore system 800. In various embodiments, as noted above, the software system may be operating and/or accessible via a distributed computing environment that enables remote access to the software without installing the software directly to the working computer. However, in other embodiments, the software may be directly installed onto local memory. The interfaces may provide information to the operator related frac tree pressures, valve positions, NPT, and the like. In various embodiments, the user interfaces are customizable for the user to receive desired information in a variety of formats.

Turning to FIG. 9, an example interface 900 includes a summary of operations at the wellsite, which may also be referred to as a "pad." A summary section 902 may provide access to historical pad information. Providing the summary section 902 enables a single location for the user to access historical information, which improves functionality and ease of access for the user. As a result, an operator may select a particular operation from a list 904 of operations.

Further illustrated in the illustrated embodiment is a time analysis section 906. The time analysis section 906 may include cumulative NPT analysis to provide information on operational NPT up to the current date. It should be appreciated that further breakdowns may be enabled, for example, by providing NPT over a period of time or the like, and that the illustrated embodiment is not intended to be limited regarding the analysis for the NPT analysis.

The interface 900 further includes pad analysis 908, which provides information such as different stages of the operation. For example, in the illustrated breakdown different time signatures for frac, wireline, NPT, and other are illustrated. As a result, an operator may evaluate what stage of the operation is currently underway. For example, more fracturing may be done at the middle than at the end, where there may be more wireline operations. Accordingly, operators may plan their later activities. For example, if data indicates the end of the fracturing job is approached, the operator may plan to have subsequent operations prepared and ready at the well site to reduce NPT.

Additionally, pad pressure information 910 may be included within the interface 900 to provide information on how a pad (and its wells) behaves during a timeframe of the operation. For example, a graphical readout for various wellheads and their respective pressures over a period of time may be provided. Spikes in pressure may be indicative of fracturing operations whereas decreases in pressure may be indicative of successful fracturing. As a result, a timing counter 912 may be provided to illustrate the total time for the job. In various embodiments, different well sites may be compared to determine where efficiencies are lost. For example, if a pad at a location having similar features (e.g., similar formation, similar location, etc.) is lagging behind another, the data may be evaluated in order to identify where efficiencies may be incorporated to improve operations. As noted above, FIG. 9 illustrates a user interface that includes a summary report, cumulative NPT, and daily pad information, such as NPT, operation percentage (e.g., frac, wireline, maintenance, etc.). Furthermore, the illustrated interface also includes pad pressure, which may be presented over a range of dates, thereby enabling the operator to visualize how the operations have been conducted over time. In various embodiments, the interface may be accessible as a software package through a distributed computing environment, and as a result, may be utilized at remote locations without installing the software package on computers directly at the well site.

FIG. 10 illustrates a user interface 1000 that includes a well configuration section 1002 providing a schematic diagram of a well configuration, which includes four wellheads in the illustrated embodiment. The configuration may be similar to the configuration illustrated in FIG. 8, which illustrates piping configurations for trees, valves, and the like. The illustrated section 1002 also provides a schematic representation of different equipment, such as using a ball drop mechanism, among others. The configuration section 1002 may include monitoring information, which may be provided in real or near-real time. In various embodiments, one or more of the valves 814 may be color coded, for example, to illustrate a position of the valve 814, as noted above. Furthermore, as described above, additional information such as textual notifications and the like may be provided regarding the position of the valves.

Additional information includes well information 1004, which may include status of the well, stage of the well, and the like. For example, certain wells may be fractured in stages, where a certain number of stages may be indicative of being in the early or late stages of the operation. By tracking the fracturing stages, the operator may obtain additional information regarding progress at the well site.

In various embodiments, the interface 1000 may provide real time or near-real time information to allow continuous monitoring of the well site. For example, a pad timer 1006, historical information 1008, and live pressure information 1010 may also be provided. In various embodiments, the pad timer 1006 illustrates time over the entire process and may further include NPT analysis, for example, by monitoring periods of time when the well it shut in. Additionally, viewing the live pressure information 1010 may enable operators to track for potential upsets and the like.

As noted, FIG. 10 illustrates the user interface that includes graphical representations of frac trees illustrative of well configurations (e.g., number of wells, ball drop systems, etc.) In various embodiments, real or near-real time monitoring is provided, and may also include indicators of valve operations (e.g., color coded for different positions). For example, open valves may be presented in green, closed valves may be presented in red, and transitioning valves may be presented in yellow. This visual indication enables operators to quickly identify conditions at the well site. Furthermore, in the embodiment illustrated in FIG. 10, real time (e.g., near-real time) well information is provided below the well configuration. For example, the well information may include a status, stage info, and the like. The illustrated embodiment also includes live pressure information (e.g., near or near-real time) which may be compiled and aggregated with other pressures to provide a compact, easy to read interface. Furthermore, in embodiments, the interface includes NPT tracking. NPT may be determined, at least in part, by information associated with the valves. For example, closed valves on the frac tree with no pressure may indicate that no operations are being conducted at the frac tree, which may be recorded as NPT. Accordingly, the problems associated with tracking NPT for a variety of vendors are addressed at least because NPT may be associated directly with the well and the various sensors monitoring activities at the well.

Embodiments of the present disclosure may aggregate and track information for a variety of wells and correlate the information with different vendors or factors to optimize and improve efficiencies at the well site. For example, NPT time may be flagged above a particular threshold and may be correlated to one or more vendors at the site. Over time, NPT time for a variety of different vendors may be recorded, thereby enabling operators to hire vendors that provide efficient returns. Additionally, a variety of other pieces of information may be correlated in an attempt to improve efficiencies. For example, a different number of stages or different pressures may be utilized for one type of underground formation, but not for another. Moreover, additional wireline operations may provide helpful, and as a result, those lessons may be incorporated into other jobs. As noted above, in various embodiments this information may be provided to a machine learning system in order to develop and recognize patterns and associations. It should be appreciated that the information may be anonymized to remove information for particular customers. As a result, job planning may be improved, and subsequent operations may further be recorded to verify that changes have a positive impact.

In various embodiments, differences in the information received from the one or more sensors described herein may be utilized in order to determine various operations at the well site. By way of example only, NPT may be computed by evaluating differences in certain operational aspects of the well site. For example, information may be received from a sensor, such as a pressure sensor or a valve position sensor, indicative of a wellbore operation. For example, high pressures may indicate that fracturing is occurring. Additionally, in embodiments, a valve in an open position may be indicative of a fracturing operating occurring. Information indicative of this operating condition may be transmitted to a control unit and/or control system, which as noted above may be a distributed computing offering or may be a locally stored software program. Information may be correlated to certain operating conditions. It should be known that these conditions may also be referred to as parameters, stages, or states. The information may be accompanied by a time stamp in order to determine a start and/or end time of the operating condition. The sensor may continuously monitor the wellhead or provide periodic updates. Second information may further be transmitted to the control unit, which may be utilized to evaluate a change in the operating condition. For example, the pressure may increase and/or decrease more than a threshold amount or the valve may be transitioned from an open state to a closed state. This changed operating condition may be correlated to a different action at the wellsite, such as a closed in well in cases where the valve is closed and/or the pressure is below a threshold amount. The second information may also be accompanied by a time stamp. The difference between the two times may then be utilized to determine how long a certain operation was occurring. It should be appreciated that subsequent changes or modifications to operations may further be used to determine other conditions at the wellsite in order to evaluate the above-referenced reports on operations.

It should be appreciated that the operations at the wellsite may be monitored using one or more sensors and that, in various embodiments, different sensors may provide different types of information. Accordingly, in various embodiments, readings from a single sensor may be used to determine operating parameters and conditions at wellsite.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

The invention claimed is:

1. A wellhead monitoring system, comprising:

a conversion assembly, the conversion assembly including an actuator element configured to modify an operating mode of a valve from manual to remote;

one or more sensors, associated with at least one of a fracturing tree or the conversion assembly, the one or more sensors obtaining wellhead operating conditions; and a control panel, adapted to receive and display information from the one or more sensors.

2. The wellhead monitoring system of claim 1, wherein the one or more sensors includes a pressure sensor, a valve position sensor, or a combination thereof.

3. The wellhead monitoring system of claim 1, wherein the conversion assembly is coupled to the valve via a valve frame, the conversion assembly engaging at least one of a valve stem or a manual operator to convert the valve into a remotely operated valve.

4. The wellhead monitoring system of claim 1, wherein the one or more sensors is a pressure sensor, the pressure sensor arranged at legs of the fracturing tree to identify closed in portions of the fracturing tree.

5. The wellhead monitoring system of claim 1, wherein the one or more sensors is a valve position sensor, the valve position sensor determining a position of the valve between an open position, a closed position, or an intermediate position.

6. The wellhead monitoring system of claim 1, further comprising a control unit configured to receive information from the one or more sensors and transmit the information to a remote system.

7. The wellhead monitoring system of claim 6, further comprising:

an interface provided via a software package executing at the control unit, the interface including one or more windows to provide real time information of well site operations or historical data associated with time spent at the well site.

8. The wellhead monitoring system of claim 1, wherein the actuator element is at least one of a hydraulic actuator, a pneumatic actuator, or an electrical actuator.

9. A method of wellhead monitoring comprising:

manually opening a valve associated with a fracturing tree;

receiving, at a control panel, information from a sensor associated with the fracturing tree; and based on the received information, actuating an actuator element to remotely modify an operating mode of the valve from manual to remote.

10. The method of claim 9, wherein the sensor comprises a pressure sensor.

11. The method of claim 9, wherein the sensor comprises a valve position sensor.

12. The method of claim 9, further comprising the step of transmitting the received information to a remote system.

13. The method of claim 9, wherein hydraulic fluid pressure is used to actuate the actuator element.

* * * * *